US008018179B2

(12) United States Patent
Frucht

(10) Patent No.: US 8,018,179 B2
(45) Date of Patent: Sep. 13, 2011

(54) APPARATUS AND METHOD FOR MONITORING AT LEAST ONE FLUORESCENT LAMP

(75) Inventor: Johannes Frucht, Soest-Ampen (DE)

(73) Assignee: Cooper Crouse-Hinds GmbH, Soest (DE)

( * ) Notice: Subject to any disclaimer, the term of this patent is extended or adjusted under 35 U.S.C. 154(b) by 372 days.

(21) Appl. No.: 12/375,868

(22) PCT Filed: Jul. 27, 2007

(86) PCT No.: PCT/EP2007/006689

§ 371 (c)(1),
(2), (4) Date: Apr. 20, 2009

(87) PCT Pub. No.: WO2008/014941

PCT Pub. Date: Feb. 7, 2008

(65) Prior Publication Data

US 2009/0309518 A1 Dec. 17, 2009

(30) Foreign Application Priority Data

Aug. 3, 2006 (DE) ..... 10 2006 036 292

(51) Int. Cl.
*H05B 41/36* (2006.01)

(52) U.S. Cl. ..... 315/291; 315/50; 315/309

(58) Field of Classification Search ..... 315/32, 315/50, 119, 127, 291, 309
See application file for complete search history.

(56) References Cited

U.S. PATENT DOCUMENTS

| | | | | |
|---|---|---|---|---|
| 3,161,746 | A * | 12/1964 | Cook et al. | 337/23 |
| 5,619,105 | A * | 4/1997 | Holmquest | 315/225 |
| 5,623,184 | A * | 4/1997 | Rector | 315/102 |
| 6,888,324 | B1 | 5/2005 | McElroy | |
| 2004/0124787 | A1 * | 7/2004 | Yang et al. | 315/291 |
| 2007/0241693 | A1 * | 10/2007 | Chan et al. | 315/291 |
| 2011/0001438 | A1 * | 1/2011 | Chemel et al. | 315/297 |

FOREIGN PATENT DOCUMENTS

| | | |
|---|---|---|
| DE | 18 38 020 U | 9/1961 |
| EP | 0 285 049 | 10/1988 |
| EP | 0 326 079 | 8/1989 |
| WO | 98/16942 | 4/1998 |
| WO | 2007/060762 | 5/2007 |

OTHER PUBLICATIONS

International Search Report (Application No. PCT/EP2007/006689), mailed Nov. 21, 2007, 3 pages.

* cited by examiner

*Primary Examiner* — Don Le
(74) *Attorney, Agent, or Firm* — Fish & Richardson P.C.

(57) ABSTRACT

An apparatus for monitoring at least one fluorescent lamp, in particular in an explosion-hazard area, which fluorescent lamp has a lamp tube with electrodes arranged at its ends in the form of filaments, and has a ballast, is improved in order to avoid an excessive temperature increase while maintaining the appropriate explosion protection in that the monitoring apparatus has at least one temperature measurement device, associated with a filament, and an electronic interruption device, by means of which interruption device the power supply can be interrupted by means of the ballast on reaching a predetermined critical temperature. The invention likewise relates to a corresponding method for monitoring at least one fluorescent lamp, in particular in an explosion-hazard area. In this method, the temperature is first of all detected in the area of at least one filament of the fluorescent lamp. The determined temperature is then compared with a predetermined critical temperature, and the power supply to the filament is interrupted by a ballast if the determined temperature reaches or exceeds the predetermined critical temperature.

21 Claims, 1 Drawing Sheet

APPARATUS AND METHOD FOR MONITORING AT LEAST ONE FLUORESCENT LAMP

Figure 1:
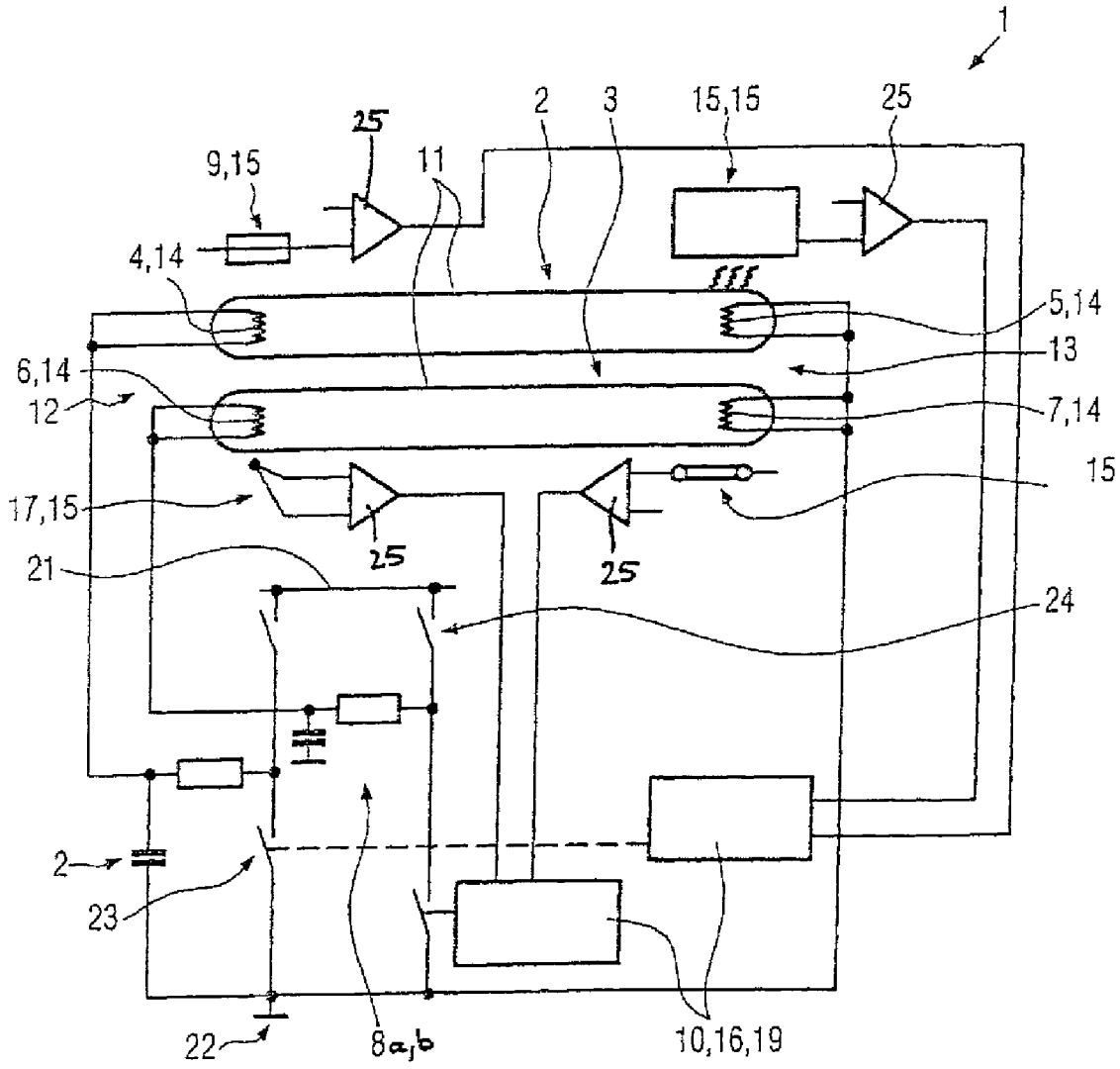

The present invention relates to a device and a method for monitoring at least one fluorescent lamp and to a corresponding luminaire comprising such a monitoring device.

Corresponding fluorescent lamps are for instance used as explosion-protected linear fluorescent luminaires in explosion-hazardous areas. It has been found in the operation of luminaires with fluorescent lamps that a local overheating of the lamp base and/or the lampholder may occur. This is generally called "end-of-life" phenomenon in the case of which the inadmissible temperature rise is due to the fact that a filament as the electrode is consumed and more and more power is needed to maintain the electrode flow for operating the fluorescent lamp.

Such inadmissible temperature rises must particularly be avoided in an explosion-hazardous area to avoid ignition of explosive mixtures.

On account of a corresponding consumption of the filaments, the exit of the electrodes out of the material is in particular rendered difficult, which may lead to an increased voltage drop. Likewise, frequent cold starts can accelerate the consumption of the filaments. The corresponding ballast of the fluorescent lamps will then generate a great power loss upon supply with a substantially constant current, the power loss possibly leading to the increased temperature of the fluorescent lamp in the area of lamp base, lampholder and filament.

It is the object of the present invention to avoid such a strong temperature increase in a corresponding fluorescent lamp, especially in the explosion-hazardous area, while maintaining the appropriate explosion protection.

This object is achieved with the features of claims 1, 10 and 21, respectively.

Patent claim 1 refers to a corresponding method that is characterized by a particularly electronic interruption of the power supply to the filament via the ballast, the interruption taking place whenever a sensed temperature in the area of at least one filament of the fluorescent lamp exceeds a predetermined critical temperature. This reliably avoids an inadmissible temperature increase. The critical temperature may here correspond to a predetermined limit value that is predetermined by the explosion protection for surface temperatures of parts of the fluorescent lamp.

According to the device the corresponding object is achieved according to claim 10 in that a temperature-measuring device is assigned to at least one filament and an interrupting device is further provided by which the power supply via the ballast can be interrupted on reaching the predetermined critical temperature. Preferably, all filaments are monitored.

Such a corresponding device can be arranged in a lamp having at least one fluorescent lamp according to patent claim 21.

According to the invention an inadmissible increase in temperature of the corresponding luminaire is reliably prevented in this way and the luminaire can particularly be used in explosion-hazardous areas.

There is the possibility that the filaments of a fluorescent lamp are heated up to different degrees. It may here be advantageous when the temperature is sensed in the area of each filament of the corresponding fluorescent lamp. As soon as one of the corresponding temperatures exceeds the predetermined critical temperature, the supply of power will be interrupted.

To ensure a switching off of the fluorescent lamp to the effect that the possibly damaged fluorescent lamp has to be exchanged prior to renewed operation, the corresponding interruption of the power supply can take place in an irreversible way by means of a fuse device. Such a fuse device is e.g. a temperature fuse that when the critical temperature is exceeded irreversibly interrupts the flow of current. Only after the fuse device and, if necessary, the fluorescent lamp have been replaced is a renewed putting into operation possible.

It is also possible that a corresponding interruption of the power supply is carried out by an electronic switching device as the interrupting device. Such a switching device is e.g. a temperature switch which when the critical temperature is reached switches off a corresponding output of the ballast for the power supply of the fluorescent lamp. Such a switching-off operation can also be carried out in a reversible way.

It is also possible that such a switching device outputs a signal to an interrupting device assigned to the ballast. Such an interrupting device may also contain the switching device and additionally a comparing device that e.g. compares the temperature determined by a temperature sensor as the temperature measuring device with the predetermined critical temperature and it is only when the critical temperature is reached or exceeded that it activates the switching device for the interrupting process.

It is also possible that at least the comparing device is contained in the temperature measuring device and activates the interrupting device from there by transmitting corresponding signals.

Since predominantly the surface temperature of the corresponding fluorescent lamps must be monitored with respect to the critical temperature, it may be regarded as sufficient when the temperature is determined from outside the lamp tube of the fluorescent lamp. This does also not require any constructional changes in the fluorescent lamp proper. However, it is also possible to integrate a corresponding temperature measuring device in the fluorescent lamp.

Further possibilities of implementing such a temperature-measuring device are offered by a temperature sensor or also an infrared sensor (IR sensor).

As an alternative to the irreversible interruption of the power supply, it is also possible to switch the switching device into a switch-on position for start of the ballast after a predetermined time interval has expired. This means that the ballast is started again after a power break.

This may be applicable by analogy to the temperature sensor or the IR sensor as temperature-measuring devices if these are correspondingly connected to the comparing and/or switching device.

It is also possible that the predetermined critical temperature is predetermined by corresponding standards for explosion-protected luminaires. However, it is also possible that the predetermined critical temperature is determined in consideration of lamp parameters, such as arrangement and/or structure of the filaments, distance of the filaments from the lamp tube, wall thickness of the lamp tube, etc. This takes into account changes in the fluorescent lamp construction by which new undefined states may arise leading to an inadmissible heating. Moreover, the behavior of a corresponding fluorescent lamp can considerably depend on ambient conditions so that the corresponding critical temperature is also determinable each time for a luminaire at a corresponding installation place. Especially in cases where the ballast is an electronic ballast, its "intelligence" can also be used for implementing comparing and/or interrupting devices in the ballast and through the ballast itself.

The present invention also relates to a luminaire with a corresponding monitoring device of the above-described kind.

An advantageous embodiment of the invention shall now be described in more detail with reference to the FIGURE attached in the drawing.

FIG. 1 is a block diagram of an embodiment of a monitoring device with different temperature-measuring devices.

FIG. 1 is a schematic block diagram showing a monitoring device according to the invention for monitoring at least one fluorescent lamp.

The monitoring device 1 is part of a luminaire 20 comprising two fluorescent lamps 2 and 3. Each of the fluorescent lamps is provided at its ends 12, 13 with corresponding filaments 4, 5 and 6, 7, respectively, as electrodes 14.

The corresponding filaments 4, 5 and 6, 7 of each fluorescent lamp 2, 3 are connected to an associated ballast (VG) 8*a, b* and particularly to an electronic ballast (EVG) 8*a, b*. Said ballast is respectively connected via switching transistors 23, 24 at the input side to a supply line 21. In the normal mode of operation these are alternatingly carrying out switching-on and switching-off operations and are both switched off in case of fault, i.e. reaching the critical temperatures, as the driving operation is stopped.

It has been found in the case of such a luminaire that a fluorescent lamp may be exposed to an inadmissible increase in temperature particularly in the area of its electrodes or filaments. This phenomenon is e.g. observed when the material of the filaments is consumed and more and more power is needed by the electronic ballast for maintaining the electrode flow inside the fluorescent lamp. Such an increase in temperature may lead to a local overheating of the filaments and thus to an inadmissible increase in temperature of the lamp base, the lampholder or even the corresponding lamp tube 11. Overheating will then lead to the above-mentioned case of fault, which is called "end-of-life" phenomenon. In exceptional cases this phenomenon will be observed at the end of the service life of the lamp. The corresponding increase in temperature will cause ignition of corresponding explosive substances particularly in the explosion-hazardous area. To prevent such a situation, the temperature is measured according to the invention in the vicinity of at least one and preferably both filaments 4, 5 and 6, 7, respectively, of each fluorescent lamp 2, 3. A corresponding temperature-measuring device 15 is used for this purpose.

In FIG. 1, each of the filaments 4, 5, 6, 7 has assigned thereto another temperature-measuring device 15. Of course, like temperature-measuring devices may also be assigned to all filaments 4 to 7.

The temperature-measuring device 15, which is assigned to the filament 4, is a temperature fuse or fuse device 9. As a rule such a temperature fuse is not allowed in an explosion-hazardous area (Ex-area) for directly switching a load because otherwise there might be spark formation. That is why the current of the fuse device is intrinsically safe and, depending on said current, an electronic interrupting device 19 is prompted to switch off the electronic ballast 8.

An amplifying device 25 may here be disposed in addition between fuse device 9 and associated interrupting device 19 and switching device 10, respectively.

The temperature-measuring device 15 assigned to the filament 5 is an infrared IR sensor 18. The signals thereof are supplied via an amplifying device 25 to the interrupting device 19. Said device may simultaneously contain a comparing device 16 that compares the temperature determined by the IR sensor 18 with a predetermined critical temperature. When the comparing device 16 detects that the critical temperature has been reached or exceeded, the switching device 10 contained in the interrupting device 19 can interrupt the power output of the corresponding EVG 8*a* by stopping the drive of the switching transistor 23 in the output of the EVG 8*a*. The interruption is only carried out for the EVG 8*a, b* that supplies voltage to the corresponding fluorescent lamp 2, 3 with the inadmissibly raised temperature.

The filament 7 has assigned thereto a temperature switch as a switching device as a further embodiment of a temperature-measuring device 15. Said switch causes a switching off of the corresponding EVG or a power interruption, respectively, via the interrupting device 19. It is also possible that the temperature switch is connected to a comparing device 16 or interrupting device 19, respectively, which only upon a corresponding switching of the temperature switch will also start an interruption of the power output of the EVG.

A temperature sensor 17 is arranged in the last filament 6 as the temperature-measuring device 15. This sensor transmits its measurement value to the interrupting device 19, which in turn comprises a comparing device 16 and a switching device 10 and interrupts the power supply to a lamp, if necessary.

Preferably, according to the invention a corresponding switching on or off of the associated EVG 8*a, b* takes place via the electronic switching device 10 or interrupting device 19, respectively, so that the EVG is switched off and the power supply to the fluorescent lamp with the inadmissible increase in temperature is interrupted. An irreversible interruption takes place in the case of the corresponding temperature fuse 9. It can only be reversed after the temperature fuse 9 and possibly also the fluorescent lamp has been replaced.

In the remaining temperature measuring devices 15, 17 and 18, a reversible interruption of the power supply takes place, the corresponding comparing device 16 comparing the measured temperatures with the critical temperature and upon detection of an inadmissible increase in temperature the switching device 10 stops the EVG. It is only after a mains break that the EVG can be restarted.

With the temperature detection according to the invention and with a corresponding switching off of the EVG one achieves as an advantage according to the invention that upon detection of the temperature the specific needs in the explosion-hazardous area can be satisfied. For instance, upon change in a fluorescent lamp design otherwise new undefined states may arise leading to an inadmissible heating. Those states may be taken into account according to the invention that regard for example the arrangement or structure of the filaments, the distance of the filaments from the lamp tube, wall thickness of the lamp tube, or the like.

According to the invention the critical temperature can further be determined in an appropriate manner in consideration of the corresponding ambient conditions of the respective fluorescent lamp if these have an impact on the ambient temperature or the heating of the fluorescent lamp, the operative position of the lamp being also considered here.

The invention claimed is:

1. A method for monitoring at least one operative fluorescent lamp in an explosion-hazardous area, the method comprising:

sensing the temperature in the area of at least one filament of the fluorescent lamp;

comparing the determined temperature with a predetermined critical temperature; and interrupting the power supply to the filament via a ballast on reaching or exceeding the critical upper temperature.

2. The method according to claim 1, wherein sensing the temperature comprises doing so in the area of each filament of the fluorescent lamp.

3. The method according to claim 1, wherein interrupting the power supply comprises doing so using a fuse device.

4. The method according to claim 1, wherein interrupting the power supply comprises doing so using an interrupting device.

5. The method according to claim 3, wherein comparing the determined temperature with a predetermined critical temperature comprises doing so using the fuse device.

6. The method according to claim 1, wherein sensing the temperature comprises doing so from outside a lamp tube of the fluorescent lamp.

7. The method according to claim 1, further comprising determining the critical temperature in consideration of lamp parameters including one or more of arrangement of the filaments, structure of the filaments, distance of the filaments to the lamp tube, and wall thickness of the lamp tube.

8. The method according to claim 1, further comprising, after the end of a predetermined time interval after interrupting the power supply to the filament restarting the ballast.

9. The method according to claim 1, wherein interrupting the power supply to the filament comprises interrupting the voltage supply to the ballast.

10. A device for monitoring at least one operative fluorescent lamp in an explosion-hazardous area, which fluorescent lamp comprises a lamp tube with electrodes arranged at its ends in the form of filaments, and a ballast, the monitoring device comprising:

at least one temperature-measuring device assigned to a filament, and an electronic interrupting device configured to interrupt the ballast on reaching or exceeding a predetermined critical upper temperature.

11. The device according to claim 10, further comprising a comparing device for comparing the temperature measured by the temperature-measuring device with the critical temperature.

12. The device according to claim 11, wherein the comparing device is contained in the temperature-measuring device.

13. The device according to claim 10, wherein the temperature-measuring device comprises a temperature fuse, a temperature sensor, or an IR sensor.

14. The device according to claim 10, wherein a temperature-measuring device is assigned to each filament of the lamp tube(s) of a luminaire.

15. The device according to claim 10, wherein the ballast is an electronic ballast.

16. The device according to claim 10, wherein the interrupting device is assigned to the ballast.

17. The device according to claim 10, wherein the interrupting device comprises a switching device which comprises drivable switching transistors.

18. The device according to claim 17, wherein the switching device is switchable into a switch-on position for start of the ballast after a predetermined time interval after interruption of the power supply.

19. The device according to claim 10, wherein the critical temperature can be predetermined in dependence upon lamp parameters such as arrangement of the filaments, structure of the filaments, distance of the filaments from the lamp tube, or wall thickness of the lamp tube.

20. The device according to claim 10, wherein the fluorescent lamp comprises multiple lamp tubes and a ballast is assigned to each lamp tube.

21. A luminaire comprising at least one fluorescent lamp and a monitoring device according to claim 10.

* * * * *

UNITED STATES PATENT AND TRADEMARK OFFICE

CERTIFICATE OF CORRECTION

PATENT NO. : 8,018,179 B2
APPLICATION NO. : 12/375868
DATED : September 13, 2011
INVENTOR(S) : Johannes Frucht It is certified that error appears in the above-identified patent and that said Letters Patent is hereby corrected as shown below:

In the Claims:

At Claim 8, Col. 5, line 20, replace "filament" with --filament,--.

Signed and Sealed this
First Day of October, 2013

Teresa Stanek Rea

Teresa Stanek Rea
*Deputy Director of the United States Patent and Trademark Office*